US009671160B2

(12) United States Patent
Wyllie et al.

(10) Patent No.: US 9,671,160 B2
(45) Date of Patent: Jun. 6, 2017

(54) MULTI NITROGEN EXPANSION PROCESS FOR LNG PRODUCTION

(71) Applicant: SINGLE BUOY MOORINGS INC., Marly (CH)

(72) Inventors: Michael Wyllie, Monaco (MC); Francesco Criminisi, Ventimiglia Imperia (IT)

(73) Assignee: SINGLE BUOY MOORINGS INC., Marly (CH)

( * ) Notice: Subject to any disclaimer, the term of this patent is extended or adjusted under 35 U.S.C. 154(b) by 481 days.

(21) Appl. No.: 14/352,827

(22) PCT Filed: Oct. 22, 2012

(86) PCT No.: PCT/EP2012/070887

§ 371 (c)(1),
(2) Date: Apr. 18, 2014

(87) PCT Pub. No.: WO2013/057314

PCT Pub. Date: Apr. 25, 2013

(65) Prior Publication Data

US 2014/0245780 A1 Sep. 4, 2014

(30) Foreign Application Priority Data

Oct. 21, 2011 (EP) ..... 11186241

(51) Int. Cl.
*F25J 1/00* (2006.01)
*F25J 1/02* (2006.01)

(52) U.S. Cl.
CPC ..... *F25J 1/0022* (2013.01); *F25J 1/005* (2013.01); *F25J 1/0042* (2013.01); *F25J 1/0052* (2013.01);
(Continued)

(58) Field of Classification Search
CPC ..... F25J 1/0022; F25J 1/0072; F25J 2270/16; F25J 1/0288; F25J 1/005; F25J 2240/12;
(Continued)

(56) References Cited

U.S. PATENT DOCUMENTS 3,677,019 A 7/1972 Olszewski
5,768,912 A 6/1998 Dubar
(Continued)

FOREIGN PATENT DOCUMENTS

FR 2 957 140 9/2011
FR 2957140 A1 * 9/2011 ..... C09K 5/042
(Continued)

OTHER PUBLICATIONS

International Search Report dated Apr. 8, 2014, corresponding to PCT/EP2012/070887.

*Primary Examiner* — Keith Raymond
(74) *Attorney, Agent, or Firm* — Young & Thompson

(57) ABSTRACT

A method of natural gas liquefaction includes at least two nitrogen refrigerant streams. Each stream undergoes a cycle of compression, cooling, expansion and heating, during which each of the nitrogen streams is expanded to a different pressure other than for the others of the at least two nitrogen streams, and, the heating occurs in one or more heat exchangers.

The expanded nitrogen streams are in a heat exchanging relationship with a stream of the natural gas and with the one or more compressed nitrogen streams in at least one of the one or more heat exchangers. At least one expanded nitrogen stream is compressed as a side stream in a stage of a main nitrogen compressor so as to combine the compressed side stream with another compressed nitrogen stream after passing the nitrogen compressor stage.

19 Claims, 7 Drawing Sheets

(52) U.S. Cl.
CPC ..... *F25J 1/0057* (2013.01); *F25J 1/0072* (2013.01); *F25J 1/0204* (2013.01); *F25J 1/0283* (2013.01); *F25J 1/0288* (2013.01); *F25J 1/0294* (2013.01); *F25J 2220/62* (2013.01); *F25J 2270/14* (2013.01); *F25J 2270/16* (2013.01); *F25J 2270/42* (2013.01)

(58) Field of Classification Search
CPC ..... F25J 2270/14; F25J 1/0203; F25J 1/0204; F25J 1/0205; F25J 1/0207; F25J 2270/62; F25J 1/0057
See application file for complete search history.

(56) References Cited

U.S. PATENT DOCUMENTS

| | | | | |
|---|---|---|---|---|
| 5,916,260 | A * | 6/1999 | Dubar | F25J 1/0022 62/613 |
| 6,250,244 | B1 | 6/2001 | Dubar et al. | |
| 6,412,302 | B1 | 7/2002 | Foglietta | |
| 7,386,996 | B2 | 6/2008 | Fredheim et al. | |
| 2010/0154470 | A1* | 6/2010 | Nilsen | F25J 1/0022 62/613 |
| 2011/0203312 | A1* | 8/2011 | Jakobsen | F25J 1/0022 62/613 |

FOREIGN PATENT DOCUMENTS

| | | |
|---|---|---|
| WO | 2009/017414 | 2/2009 |
| WO | 2009/072900 | 6/2009 |
| WO | 2009/130466 | 10/2009 |

* cited by examiner

MULTI NITROGEN EXPANSION PROCESS FOR LNG PRODUCTION

BACKGROUND OF THE INVENTION

There are five classes of gas liquefaction processes used worldwide for LNG (Liquefied natural gas) production.

These vary in complexity and efficiency—basic systems with lower levels of efficiency (high energy demand per unit of LNG produced) and more complex systems with higher efficiency. There is a trade off to be made between complexity (in terms of Capex and Opex) and efficiency.

The 5 classes can be categorized as simple gas expansion, enhanced expansion, single cycle refrigeration, dual cycle refrigeration, triple cycle refrigeration.

The efficiency of LNG plants can be measured in terms of the specific power demand per ton of LNG produced, which can be in the range of 250 kWh/t (kilowatt hour per ton) for the most efficient large scale modern plants, up to 600 to 700 kWh/t for small scale simple re-liquefaction and peak shaving plants.

The many processes available within these 5 classes also differ in some important ways, such as inherent safety risk, number of plants operating worldwide and suitability of offshore operations.

Within the second category of enhanced expander plants, various patented processes exist that aim in different ways to increase the efficiency of the single expander processes. These processes typically make use of "companders" (gas turbo-expanders directly coupled to gas compressors) in order to generate more cooling. Most processes use a dual stage, i.e., two levels of gas expansion, and hence gas cooling, to optimize the efficiency of the process. The refrigeration fluid can be either feed gas (Mustang design), Nitrogen (BHP, Kanfa Aragon, APCI and Statoil designs), or one nitrogen loop and one methane loop (CB&I Niche design).

The nitrogen based expander process has many attractions, especially in terms of ease of start-up and shutdown, leading to higher availability, and better inherent safety since the process does not contain large inventories of flammable refrigerants. However, their efficiency is lower than the more popular dual stage refrigerant cycle processes. Existing dual stage expander processes have specific power demands typically in the range from about 420 to about 500 kWh/t, whereas the aim of this new idea is to be able to reduce the specific power demand below 400 kWh/t.

Natural gas which is obtained in the form of a gas from gas and oil fields occurring in nature, is discharged from the terrestrial source to form a natural gas feed which requires processing before it can be used commercially. The natural gas feed enters a processing facility and is processed through a variety of operations in different installations to finally emerge as liquid natural gas (LNG) in a form which is suitable for use. The liquid gas is subsequently stored and transported to another suitable site for revaporisation and subsequent use. In the processing of the natural gas feed the gas emerging from the naturally occurring field must be first pretreated to remove or reduce the concentrations of impurities or contaminants, such as for example carbon dioxide and water or the like, before it is cooled to form LNG in order to reduce or eliminate the chances of blockage to equipment used in the processing occurring and to overcome other processing difficulties. One example of the impurities and/or contaminants are acid gases such as carbon dioxide and hydrogen sulphide. After the acid gas is removed in an acid gas removal installation, the feed gas stream is dried to remove all traces of water. Mercury is also removed from the natural feed gas prior to cooling. Once all of the contaminants or unwanted or undesirable materials are removed from the feed gas stream it undergoes subsequent processing, such as cooling, to produce LNG.

Typically, natural gas compositions will liquefy, at atmospheric pressure, in the temperature range −165° C. to −155° C. The critical temperature of natural gas is about −90° C. to −80° C., which means that in practice the natural gas cannot be liquefied purely by applying pressure, but must be also be cooled below the critical temperature.

Cooling of the natural gas feed may be accomplished by a number of different cooling process cycles, one of them involving the use of a nitrogen expander cycle in which, in its simplest form, a closed loop is employed in which nitrogen gas is first compressed and cooled to ambient conditions with air or water cooling and then further cooled by counter-current exchange with cold low pressure nitrogen gas. The cooled nitrogen stream is then expanded through a turbo-expander to produce a cold low pressure stream. The cold nitrogen gas is used to cool the natural gas feed and the high pressure nitrogen stream in a heat exchanging device. The work produced in the expander by the nitrogen expanding is recovered in a nitrogen booster compressor connected to the shaft of the expander. Thus, in this process cold nitrogen is not only used to liquefy the natural gas by cooling it but the cold nitrogen is also used to precool or cool nitrogen gas in the same heat exchanger. The precooled or cooled nitrogen is then subsequently further cooled by expansion to form the cold nitrogen refrigerant.

U.S. Pat. No. 6,412,302 disclose a dual expander niche LNG process. In this process for LNG production dual independent expander refrigeration cycles are used.

WO2009017414 in the name of Kanfa Aragon discloses a nitrogen dual expander process for producing LNG which is similar to the BHP process.

WO2009130466 and U.S. Pat. No. 7,386,996 both in the name of Statoil, discloses a nitrogen dual stage expander process, which is an improved version of the BHP process, but which is still based on two expanders.

U.S. Pat. No. 6,250,244 discloses that the gradient of the warming curve of the refrigerant can be altered by changing the flow rate of the refrigerant through the heat exchangers: specifically, the gradient can be increased by decreasing the refrigerant flow rate. It also discloses that if the nitrogen flow is split into two streams it is possible to make the nitrogen warming curve change from a single straight line into two intersecting straight line portions of different gradient. An example of such a process is disclosed in U.S. Pat. No. 3,677,019. This specification discloses a process in which the compressed refrigerant is split into at least two portions, and each portion is cooled by work expansion. Each work expanded portion is fed to a separate heat exchanger for cooling the gas to be liquefied. This causes the refrigerant warming curve to comprise at least two straight line portions of different gradient. This aids in the matching of the warming and cooling curves and improves the efficiency of the process. This specification was published over twenty years ago, and the process disclosed therein is inefficient by modern standards.

In U.S. Pat. No. 6,250,244 there is disclosed a process for liquefying a permanent gas stream, which also involves splitting the refrigerant stream into at least two portions in order to match the cooling curve of the gas to be liquefied with the warming curve of the refrigerant. The outlet of all the expanders in this process is at a pressure above about 1 MPa. The specification suggests that such high pressures increase the specific heat of the refrigerant, thereby improving the efficiency of the refrigerant cycle. In order to realize an efficiency improvement it is necessary for the refrigerant to be at, or near, its saturation point at the outlet of one of the expanders, because the specific heat is higher near to saturation. If the refrigerant is at the saturation point, then under these conditions there will be some liquid in the refrigerant that is fed to the heat exchangers. This leads to additional expense, because either the heat exchanger needs to be modified in order to handle a two-phase refrigerant, or the refrigerant needs to be separated into liquid and gaseous phases before being fed to the heat exchanger.

U.S. Pat. No. 6,250,244 in the name of BHP discloses a nitrogen dual expander process. In this process for producing LNG a single phase nitrogen refrigerant is used in such a way that the refrigerant stream is divided into at least two separate portions which are passed through separate turbo-expanders before being admitted to separate heat exchangers so that the warming curve of the refrigerant more closely matches the cooling curve of the product being liquefied so as to minimize thermodynamic inefficiencies and hence power requirements involved in operation of the method. U.S. Pat. No. 5,768,912 discloses a prior art nitrogen expander process with two parallel placed turbo expanders.

SUMMARY OF THE INVENTION

The present application discloses a nitrogen expansion process which uses different expander pressure levels and a nitrogen compression unit with multiple compressors and one or more side streams of nitrogen to be compressed.

The present invention relates to a method of natural gas liquefaction comprising at least two nitrogen refrigerant streams, each stream undergoing a cycle of compression, cooling, expansion and heating, during which each of the nitrogen streams is expanded to a different pressure other than for the others of the at least two nitrogen streams, and, the heating occurs in one or more heat exchangers;

the expanded nitrogen streams being in a heat exchanging relationship with a stream of the natural gas and with the one or more compressed nitrogen streams in at least one of said one or more heat exchangers, wherein at least one expanded nitrogen stream is compressed as a side stream in a stage of a main nitrogen compressor so as to combine the compressed side stream with another compressed nitrogen stream after passing said nitrogen compressor stage.

According to an aspect of the invention, there is provided a method as described above wherein the main nitrogen compressor comprises at least two compressor stages.

According to an aspect of the invention, there is provided a method as described above wherein the nitrogen compressor unit comprises at least two compressors coupled on a common drive shaft.

According to an aspect of the invention, there is provided a method as described above wherein the compressed nitrogen stream is divided over at least two parallel placed expanders to different pressure levels.

According to an aspect of the invention, there is provided a method as described above wherein each expander is connected over a common drive shaft to a compressor for compressing a nitrogen flow.

According to an aspect of the invention, there is provided a method as described above wherein each compressor connected to the respective expander receives and compresses a part of the nitrogen stream that is compressed by the main nitrogen compressor.

According to an aspect of the invention, there is provided a method as described above wherein at least one compressor connected to the respective expander receives and compresses at least a part of the nitrogen stream that passed the heat exchanger.

According to an aspect of the invention, there is provided a method as described above wherein the main nitrogen compressor is gas turbine driven or electric motor driven or steam turbine driven.

According to an aspect of the invention, there is provided a method as described above wherein the expansion comprises a high pressure, a intermediate pressure and a low pressure expansion stage in a respective expander.

According to an aspect of the invention, there is provided a method as described above wherein the main nitrogen compressor comprises three compressor stages and receives two side streams with different pressures.

According to an aspect of the invention, there is provided a method as described above wherein the three compressors are coupled on a common drive shaft According to an aspect of the invention, there is provided a method as described above wherein two of the three parallel placed expanders are turbo-expanders and the third expander is a Joule-Thompson valve.

A process is claimed for a nitrogen based triple expansion process for LNG production with multiple parallel placed expanders combined with multiple nitrogen pressure levels (high (HP: warm), intermediate (IP) and a low pressure (LP: cold) level and with at least one nitrogen side stream for a nitrogen compressor unit.

The present invention also relates to a natural gas liquefaction apparatus comprising a heat exchanger system of one or more heat exchangers for placing the natural gas in a heat exchanging relationship with multiple nitrogen refrigerant streams; at least two compressors for compressing a first and an at least second nitrogen refrigerant stream; a first expander for expanding the first nitrogen stream to a first pressure and at least a second expander for expanding the at least second nitrogen stream to an at least second, lower pressure than the first pressure, wherein the apparatus further comprises a main nitrogen compressor with at least two compressor stages, each compressor stage being arranged for receiving an associated nitrogen stream, and each nitrogen stream having a different pressure other than the other of the at least two nitrogen streams, one nitrogen stream being a side stream which will be combined with the other nitrogen stream. Preferred is a configuration which uses three nitrogen turbo-expanders that are operating in parallel.

The invention is a further improvement of the known nitrogen dual expander process by adding a third expander stage to improve efficiency.

According to an aspect of the invention, there is provided an apparatus as described above wherein the one nitrogen stream is combined with the other nitrogen stream after passing the compressor stage associated with the one nitrogen stream before entry of the other nitrogen stream into the compressor stage associated with the other nitrogen stream.

According to an aspect of the invention, there is provided an apparatus as described above wherein the main nitrogen compressor comprises at least two compressors coupled on a common drive shaft.

According to an aspect of the invention, there is provided an apparatus as described above wherein the compressed nitrogen stream is divided over at least two parallel placed expanders to different pressure levels.

According to an aspect of the invention, there is provided an apparatus as described above wherein each expander is connected over a common drive shaft to a compressor arranged for compressing a nitrogen flow.

According to an aspect of the invention, there is provided an apparatus as described above wherein each compressor receives and compresses a part of the nitrogen stream that is compressed by the main nitrogen compressor.

According to an aspect of the invention, there is provided an apparatus as described above wherein at least one compressor receives and compresses at least a part of the nitrogen stream that passed the heat exchanger system before it flows to the main nitrogen compressor.

According to an aspect of the invention, there is provided an apparatus as described above wherein the main nitrogen compressor unit is gas turbine driven or electric motor driven or steam turbine driven.

According to an aspect of the invention, there is provided an apparatus as described above wherein the first and at least second expander comprise a high pressure, a intermediate pressure and a low pressure expansion stage in a respective expander.

According to an aspect of the invention, there is provided an apparatus as described above wherein the main nitrogen compressor comprises three compressors and receives two side streams with different pressures.

According to an aspect of the invention, there is provided an apparatus as described above wherein two of the three parallel placed expanders are turbo-expanders and the third expander is a Joule-Thompson valve.

The method and process according the invention is in fact very suitable as an optimized N2 expander process which has specific advantages for offshore use; it capitalizes on the inherent safety benefits of the N2 cooling process, but although adding some complexity, it maximizes the system efficiency combined with a relative small process footprint.

BRIEF DESCRIPTION OF THE DRAWINGS

The invention will be further described below in connection with exemplary embodiments with reference to the accompanying drawings, wherein.

DESCRIPTION OF EMBODIMENTS

Figure 1:
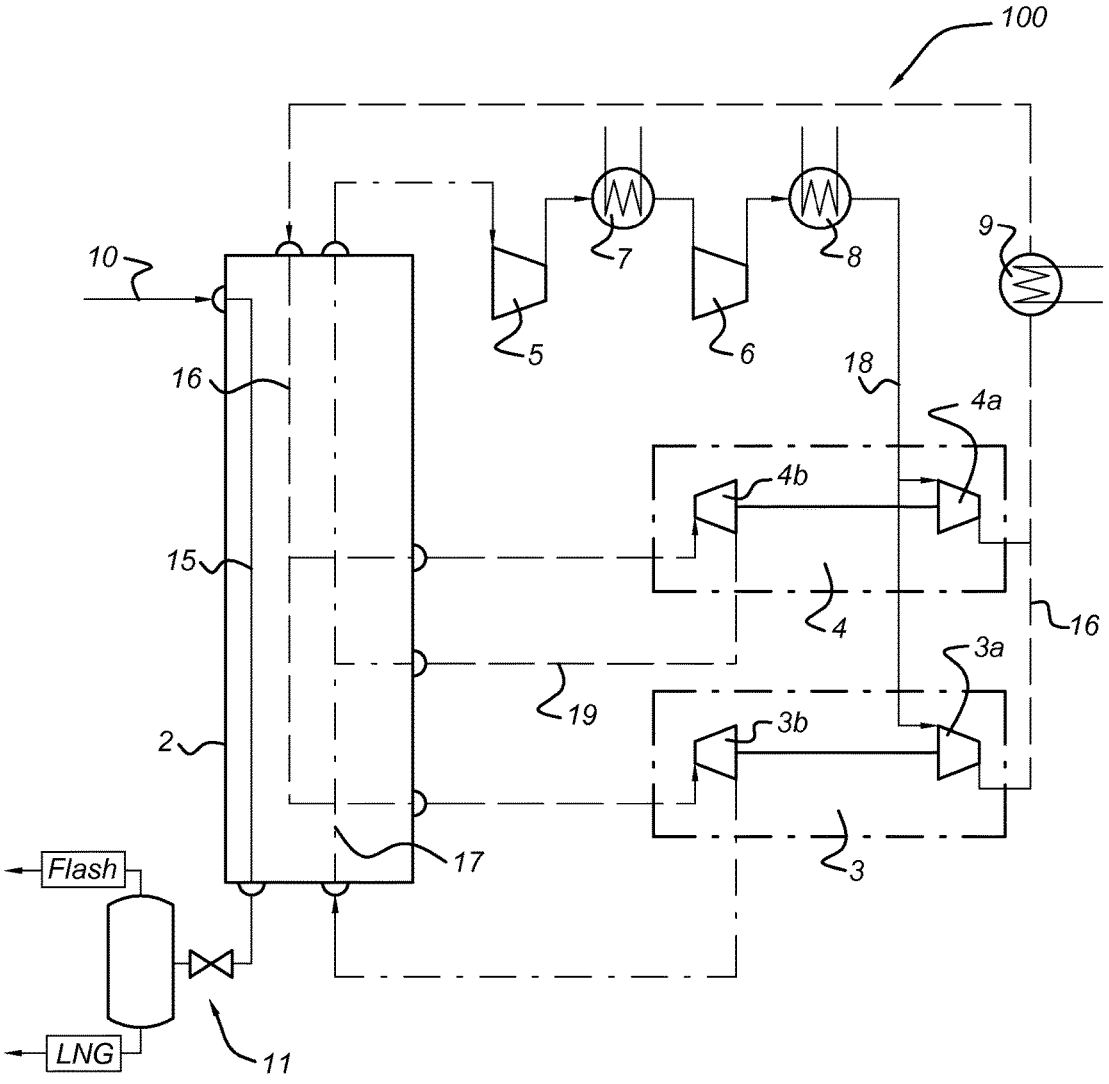
Fig. 1 Prior art
FIG. 1 shows a prior art dual nitrogen expander process of Statoil.

FIG. 1 shows a prior art system for a dual nitrogen expander process of Statoil for the liquefaction of natural gas.

The process system 100 according to the prior art comprises a heat exchanger system 2, i.e. one or more heat exchangers or heat sinks or "cold boxes", a first (turbo) expander unit 3, a second turbo expander unit 4, and cycle compressor(s) 5, 6. Further, the process facility comprises inter-coolers and after-coolers 7, 8, 9.

The process system 100 comprises an inlet for natural feed gas 10. The natural feed gas passes as a natural gas stream 15 through the heat exchanger system 2 towards a flash device 11 which separates liquid natural gas (LNG) from residual gas (flash gas). Within the heat exchanger system 2 the stream of natural feed gas is cooled by a counter flow 17, 19 of cold nitrogen gas. The cold nitrogen counter flow is generated in the first and second expanders 3*b*, 4*b*. At the outlet of the heat exchanger system the warm nitrogen is sent to the main cycle compressor 5, 6. that produce a high pressure stream 18 of nitrogen. After the high pressure stream has passed the compressors 3*a*, 4*a* of the first and second turbo expanders 3, 4, the nitrogen stream continues as a high pressure nitrogen stream 16. The high pressure stream 16 enters the heat exchanger 2 and flows parallel to the natural feed gas stream 15 towards the expander parts 3*b*, 4*b* of the turbo expanders 3, 4. After passing the expander parts, the nitrogen stream has cooled further and continues as the counter flow 17 in the heat exchanger system 2. With reference to FIG. 1; the nitrogen expander concept has already been enhanced in terms of efficiency by moving from a single pressure level cycle with one expander, to dual pressure levels with 2 expanders.

Figure 2:
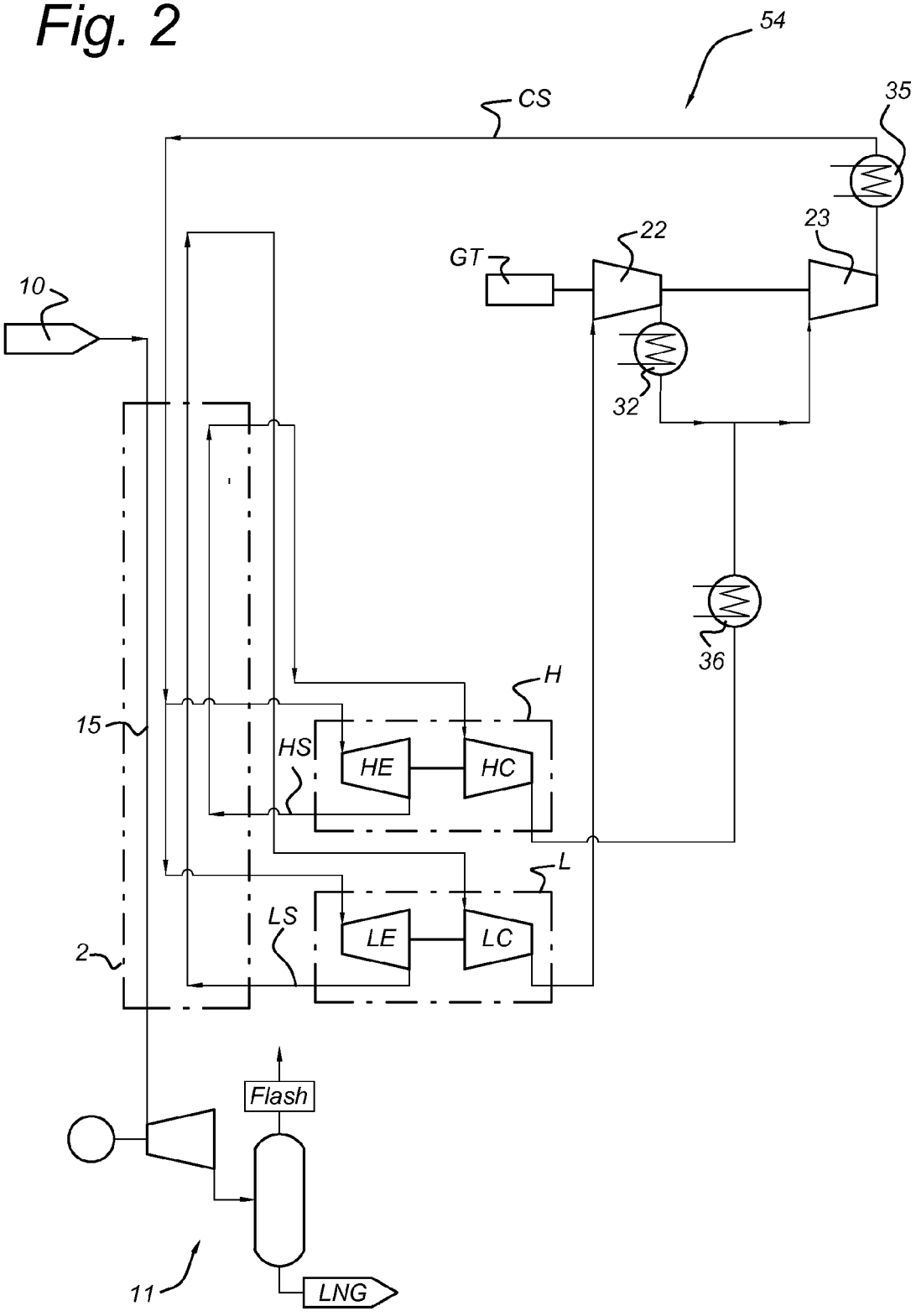
FIG. 2 shows an dual expansion process according to an embodiment of the invention.

FIG. 2 shows an alternative process scheme 54 according to an embodiment of the invention. In this embodiment, the expansion of the nitrogen gas cycle is handled by two turbo expanders H, L.

One turbo expander L is arranged for a relatively low pressure expansion of the nitrogen gas, the other turbo expander H is arranged for a relatively high pressure expansion.

The main nitrogen compressor in this embodiment comprises two coupled compressor stages or units 22, 23. A first compressor stage 22 has an inlet coupled to the outlet of the compressor part LC of the low pressure turbo expander L. The stream feeding the first compressor 22 is coming from the compressor part LC.

A second compressor stage 23 has an inlet stream coming from the outlet of the compressor part HC of the high pressure turbo expander H.

The outlet of the first compressor stage is coupled to the inlet of the second compressor stage in such a way that the compressor outlet stream from the low pressure turbo expander L after being pressurized in the first compressor stage is added to the compressor outlet stream from the high pressure turbo expander before the inlet of the second compressor stage.

In this manner a high pressure compressed stream CS is formed that enters the heat exchanger system 2 in a flow parallel to the natural feed gas 15.

Within the heat exchanger system the high pressure compressed stream CS is split to a first entry stream for the high pressure expander HE and a second entry stream for the low pressure expander LE.

In each of the turbo expanders the respective entry stream is expanded as a cooled nitrogen stream HS; LS that is transported through the heat exchanger system 2 in a counter flow relative to the natural feed gas stream and the high pressure compressed nitrogen stream CS. After passing the heat exchanger system 2 each of the cooled nitrogen streams HS, LS is directed to the inlet of the respective compressor HC; LC. Thus, the cooled nitrogen stream LS from the low pressure turbo expander L is transported through the heat exchanger 2 and then directed to the inlet of the compressor part LC of the low pressure turbo expander. The cooled nitrogen stream HS from the high pressure turbo expander H is transported through the heat exchanger system and then directed to the inlet of the compressor part HC of the high pressure turbo expander.

Intercoolers/aftercoolers are installed: an intercooler 36 is installed between the compressor outlet of the high pressure turbo expander H and the inlet of the second compressor stage 23. A second intercooler 32 is installed between the outlet of the first compressor stage 22 and the inlet of the second compressor stage 23. A third intercooler 35 is installed at the outlet of the second compressor stage.

It is noted that the single heat exchanger 2 may be embodied as a number of heat exchanger units, for example plate-fin type heat exchanger, spiral wound type heat exchanger of shell-and-tube type heat exchanger.

Figure 3:
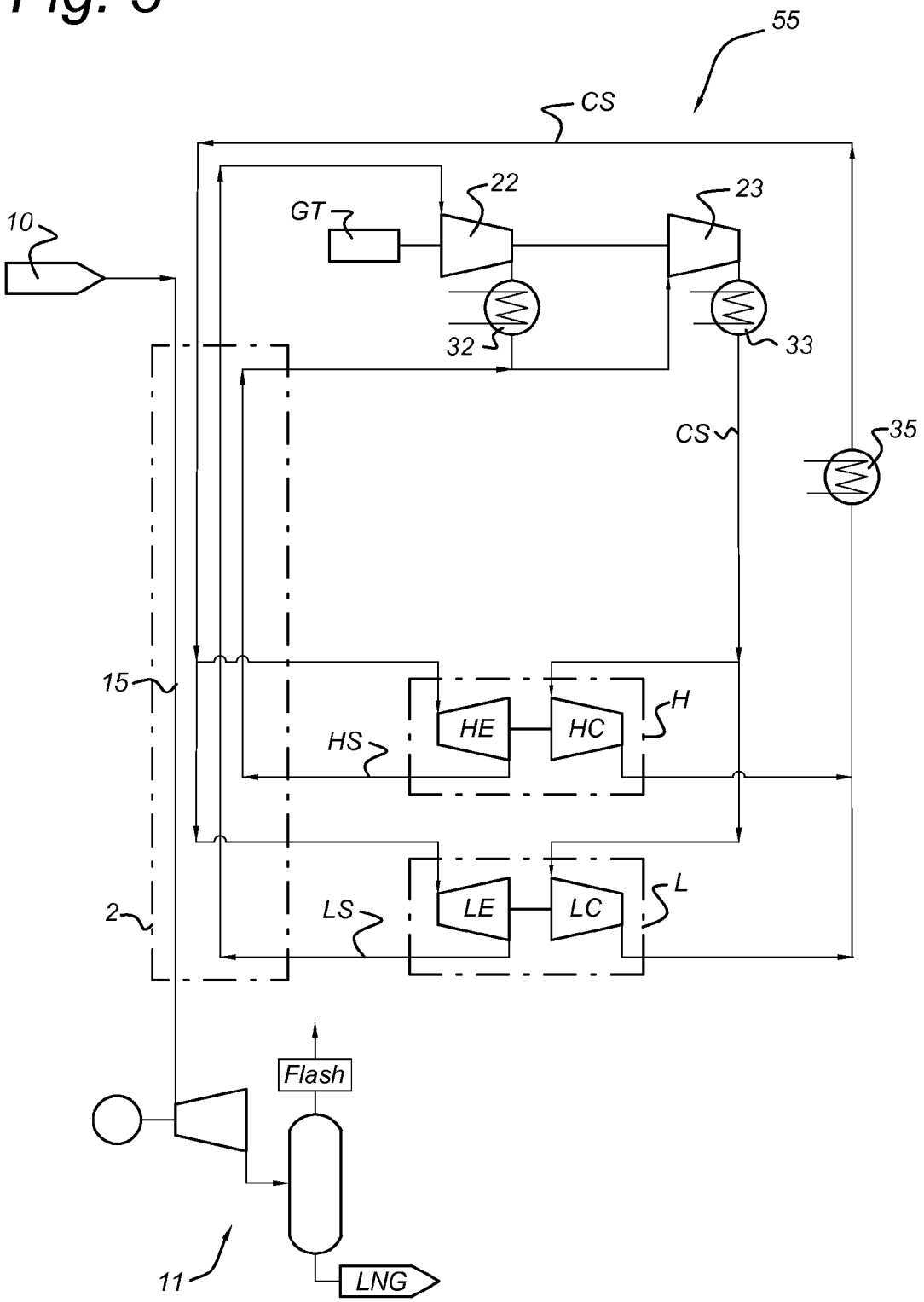
FIG. 3 shows another dual expansion process according to an embodiment of the invention.

FIG. 3 shows another alternative processing scheme 55 according to an embodiment of the invention. Like the embodiment as shown in FIG. 2, the process scheme applies an expansion of the nitrogen gas cycle handled by two turbo expanders H, L, and a dual stage main nitrogen compressor.

In this embodiment however, the high pressure stream CS produced by the main nitrogen compressor is not transported directly to the heat exchanger but first transported through the compressor parts HC; LC of the high pressure turbo expander and the low pressure turbo expander, respectively. The high pressure stream DS from the main nitrogen compressor is split in a stream to the compressor part HC of the high pressure turbo expander and a stream to the compressor part LC of the low pressure turbo expander. After passing the respective compressor parts, the streams are combined into a single stream that passes the heat exchanger in a flow parallel to the natural feed gas stream.

In or at the heat exchanger 2 the compressed stream CS is split into a stream to the inlet of the high pressure expander HE and a stream to the inlet of the low pressure expander LE. Each of the streams after expansion cooling in the respective expander part HE; LE is transported through the heat exchanger 2 and then transported to the corresponding compressor stages 22; 23 of the main nitrogen compressor: the stream from the low pressure turbo expander L to the inlet of the first compressor stage 22, the stream from the high pressure turbo expander H to the inlet of the second compressor stage 23. The pressurized stream from the first compressor stage is joined with the stream for entering the inlet of the second compressor stage.

Intercoolers 32; 33 are arranged to cool the streams after compressing.

Figure 4:
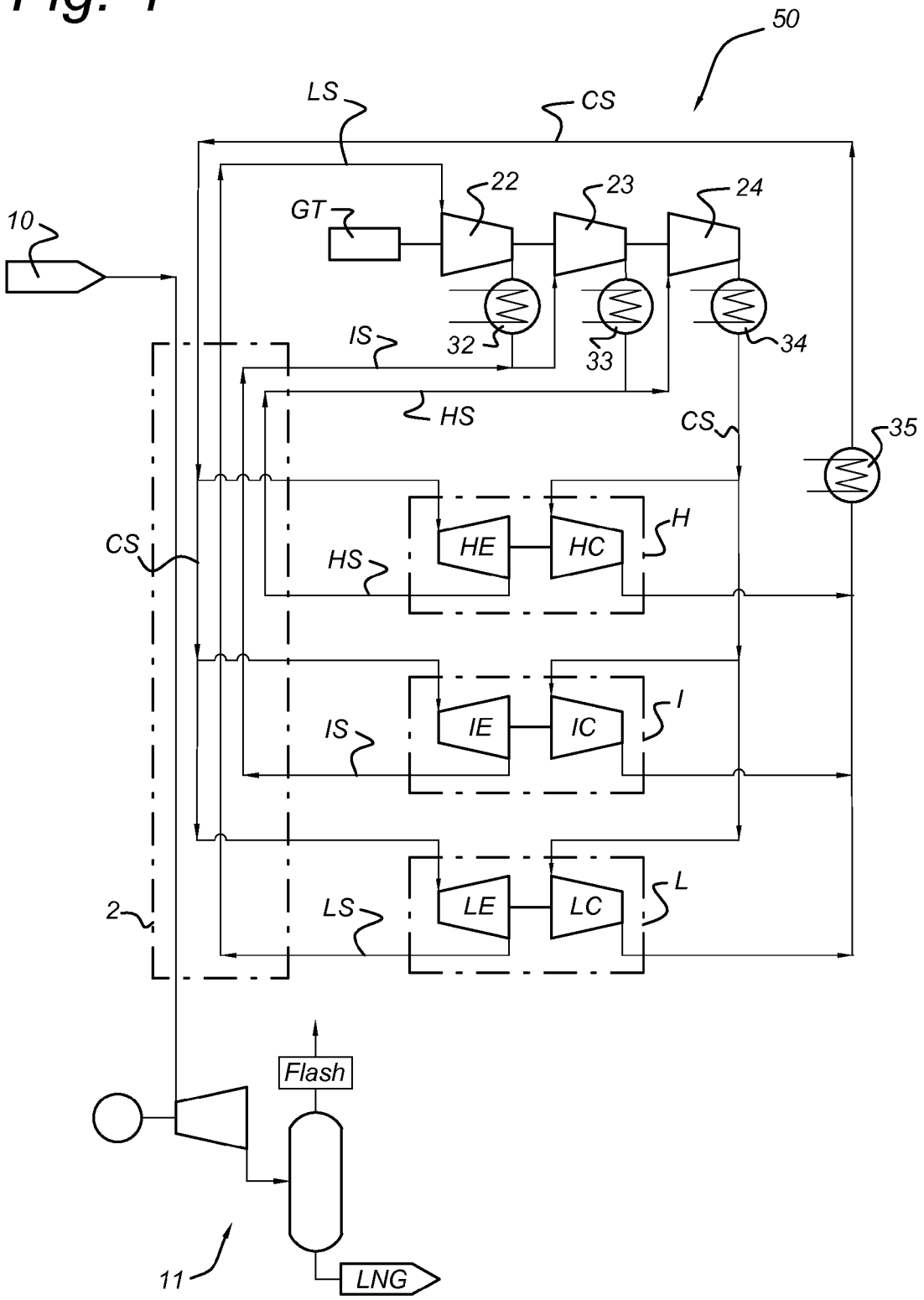
FIG. 4 shows a first triple expansion process scheme according to an embodiment of the invention.

FIG. 4 shows a first triple expansion process scheme 50 according to an embodiment of the invention.

The liquefaction process can be further improved by adding a third pressure level, and a third expansion step. In this configuration four pressure levels would exist for the circulation of nitrogen streams—high pressure from the compressor discharge, two intermediate pressures, and low pressure.

HP (high pressure) nitrogen would be cooled in the cold box, and the first extraction stream would feed the HP expander HE, generating a cold N2 stream which is fed back into the heat exchanger system, and returns to the third stage suction of the main nitrogen compressor 22, 23, 24.

More cooled HP nitrogen is taken in a second extraction stream to feed the IP (intermediate pressure) expander IE, generating a second cold N2 stream which is fed back into the heat exchanger system, and returns to the second stage suction of the main nitrogen compressor.

The remaining sub-cooled HP nitrogen is taken in a third extraction stream to feed the LP (low pressure) expander LE, generating a third cold N2 stream which is fed back into the heat exchanger system, and returns to the first stage suction of the main nitrogen compressor.

Compressed nitrogen from the third stage compressor discharge is further boosted in pressure using the compressors HC, IC, LC coupled to the three expanders HE, IE, LE respectively. Each compressor is coupled to a respective expander over a common drive shaft.

In this way, three levels of chilling are produced, and at the same time, since all return flows from the heat exchanger system are coupled to the main nitrogen compressor, the main nitrogen gas compressor power is minimized, hence improving the overall efficiency of the LNG production process.

In addition, the three temperature levels created by the respective expanders provide a cooling curve in the heat exchanger system which has improved efficiency.

This is illustrated in more detail with reference to FIG. 4.

As shown in FIG. 4, three pressure levels are present in the turbo expanders, which comprise a high pressure level turbo expander H, an intermediate pressure turbo expander I and a low pressure turbo expander L. Each turbo expander comprises an expander part HE, IE, LE and a compressor part HC; IC; LC, in which the drive shaft of the expander part is coupled with the drive shaft of the compressor part. The outlet for expanded nitrogen for each expander HE; IE; LE is coupled to the heat exchanger system 2 for transfer of cold expanded nitrogen in a high pressure stream HS, an intermediate pressure stream IS and a low pressure stream LS, respectively, through the heat exchanger.

Further the cycle compressor arrangement is made of three nitrogen compressor stages 22, 23, 24 that are arranged for compressing the respective expanded nitrogen gas streams from each of the expanded nitrogen streams HS, IS, LS into a single compressed stream CS. At the outlet of each compressor stage an intercooler 32, 33, 34 is arranged for cooling the compressed nitrogen stream.

The compressed stream CS is arranged to pass the compressor side HC; IC; LC for driving each one of the high pressure turbo expander H, intermediate pressure turbo expander I and low pressure turbo expander L. After delivery of kinetic energy to the turbo expanders the compressed stream CS is cooled by an intercooler 35 and then transported through the heat exchanger 2, in a stream parallel to the natural feed gas stream. The compressed stream CS is cooled during passage through the heat exchanger.

Within the heat exchanger system or at the entry therein, the compressed stream is distributed over separate streams to each of the high pressure expander HE, intermediate pressure expander IE and low pressure expander LE as feed for the nitrogen gas to be expanded in each respective expander HE; IE; LE at a high, intermediate and low pressure level, respectively.

The main nitrogen compressor assembly (coupled nitrogen compressor stages) is driven by a compressor driver GT, which in an embodiment is gas-turbine, coupled by a drive shaft to the main nitrogen compressor. In an alternative embodiment, the compressor driver GT may be a motor such as an electric motor or a steam turbine.

Figure 5:
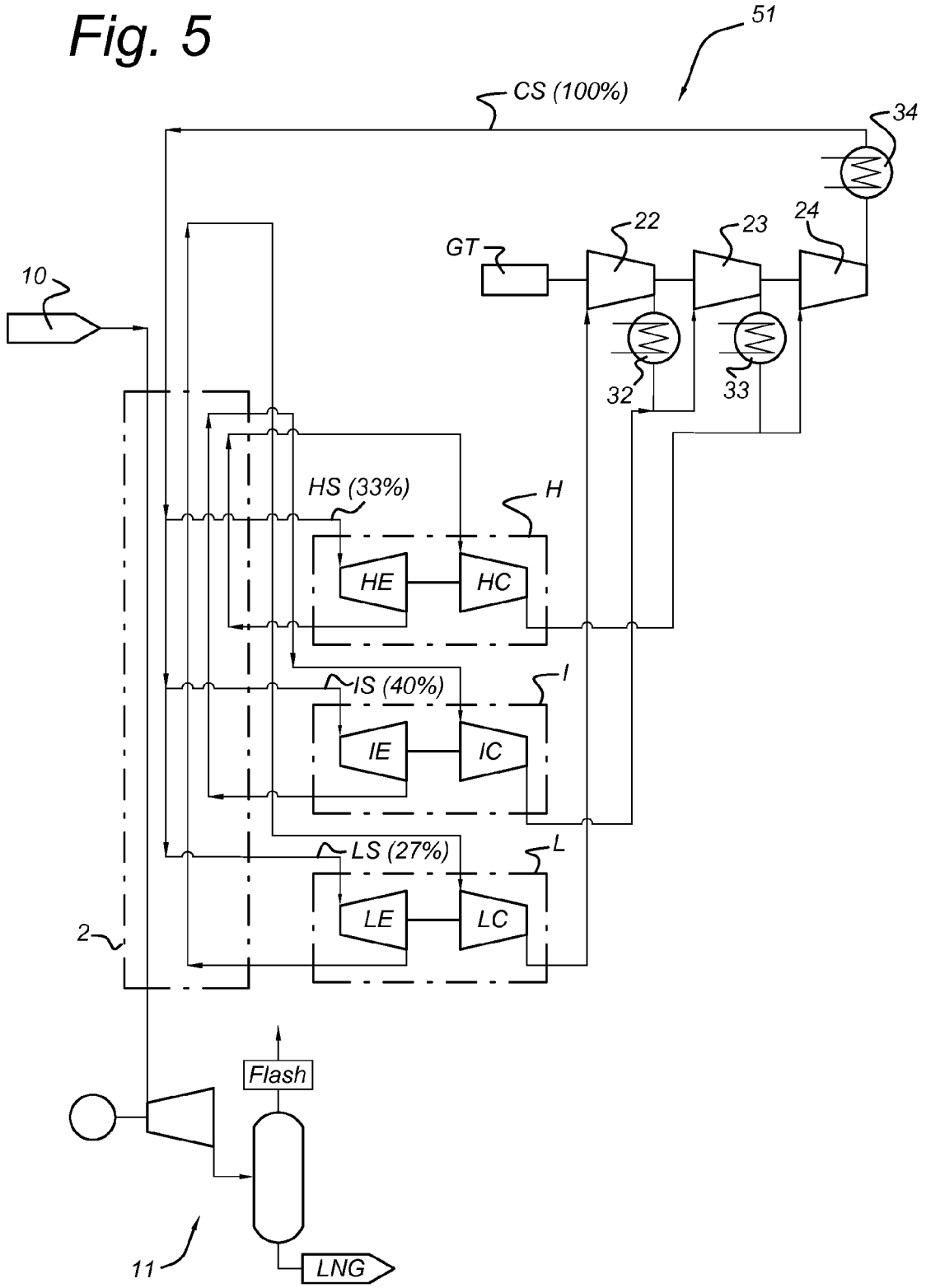
FIG. 5 shows an alternative triple expansion process scheme according to an embodiment of the invention.

FIG. 5 shows an alternative triple expansion process scheme 51 according to an embodiment of the invention Within FIG. 5 exemplary pressure levels (in bars) and flow rates (% of total flow) are displayed. The values presented here are only indicative and are not intended to limit the invention.

In this alternative embodiment (FIG. 5), the compressors HC; IC; LC coupled to the respective HP, IP and LP expanders HE, IE, LE are used to boost the pressure of the HP, IP and LP gas respectively, before the streams are sent to the third 24, second 23 and first 22 stages of the main nitrogen compressor, respectively. In each stream at the outlet of the compressor part of the main nitrogen compressor 22, 23, 24 an intercooler 32; 33; 34 is arranged for cooling the respective compressed stream.

In an exemplary embodiment, the compressed stream CS before entry of the heat exchanger is a full flow (100%) of nitrogen at a pressure of about 65 bar (1 bar 1 atm). In the heat exchanger the compressed stream is split in a high pressure stream HS (33% flow, 29.8 bar), an intermediate stream IS (40%, 17.1 bar) and a low pressure stream LS (27%, 12 bar).

After expanding each stream in the high pressure expander part HE, the intermediate pressure expander part IE and the low pressure expander part LE, respectively, the respective stream is fed to the heat exchanger system 2 and after passing the heat exchanger to the respective compressor part HC; IC; LC.

In the example, the low pressure stream LS is boosted to 16.5 bar and entered into the first nitrogen compressor stage 22 of the main nitrogen compressor; the intermediate pressure stream IS to 28 bar and entered into the second nitrogen compressor stage 23; and the high pressure stream to about 43.4 bar and entered into the third nitrogen compressor stage 24.

Figure 6:
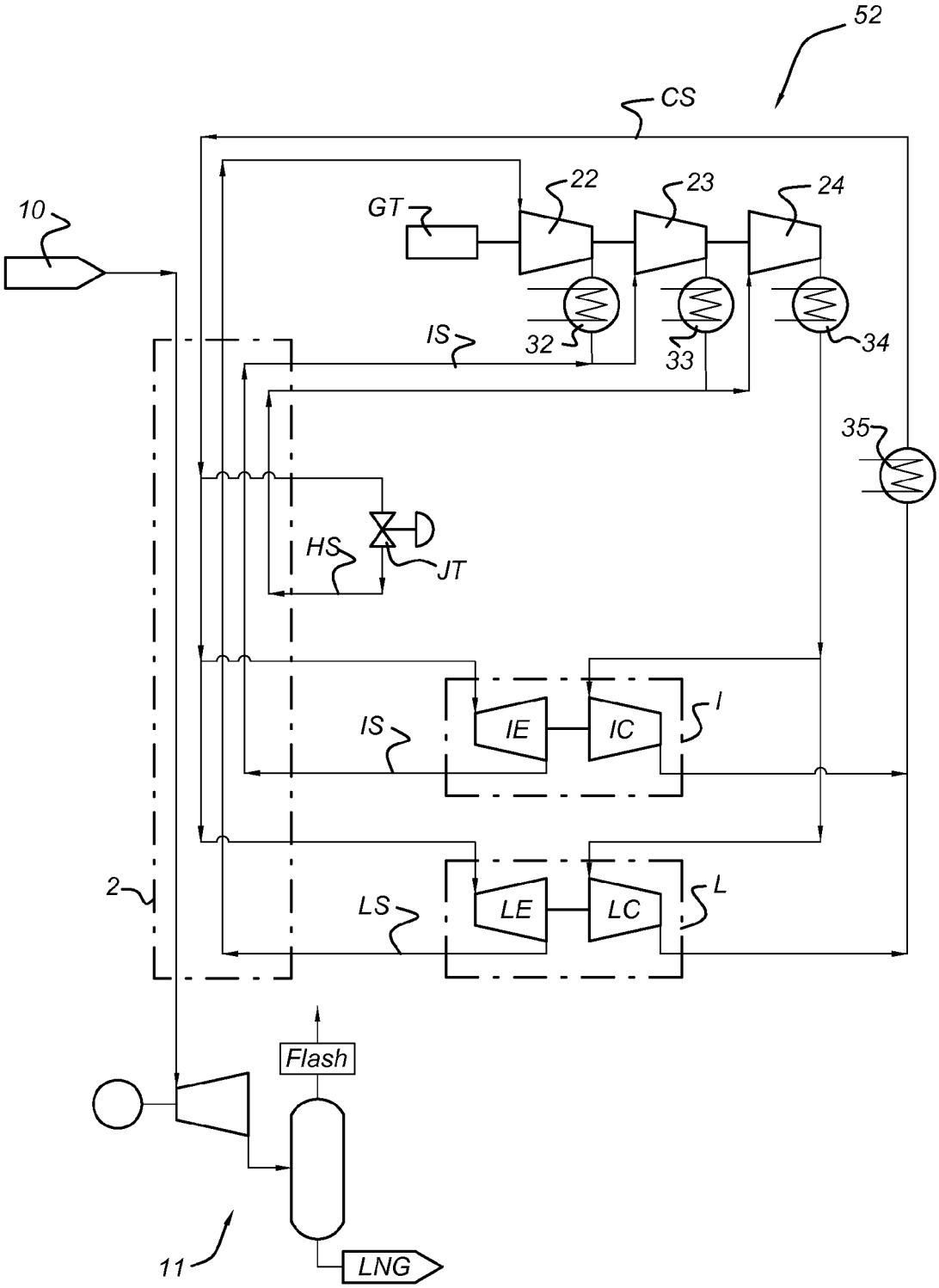
FIG. 6 shows a dual expansion process according to an embodiment of the invention with a Joule-Thompson (JT) valve for HP expansion stage.

FIG. 6 shows a dual expansion process scheme 52 according to an embodiment of the invention with a Joule-Thompson (JT) valve for HP expansion stage.

In this alternative embodiment (FIG. 6), that is arranged with a similar nitrogen feed scheme as the embodiment described with reference to FIG. 4, instead of the HP turbo-expander a Joule Thompson (JT) expansion valve is arranged in the high pressure stream. The HP turbo expander has been replaced with the Joule-Thompson (JT) expansion valve, and the HP compressor is deleted. After passing the heat exchanger 2, the high pressure stream is now directly fed to the third nitrogen compressor stage 24 of the main nitrogen compressor.

This embodiment may allow a simpler way of generating three pressure levels of chilling, but will be less efficient than the process shown in FIGS. 4 and 5.

Figure 7:
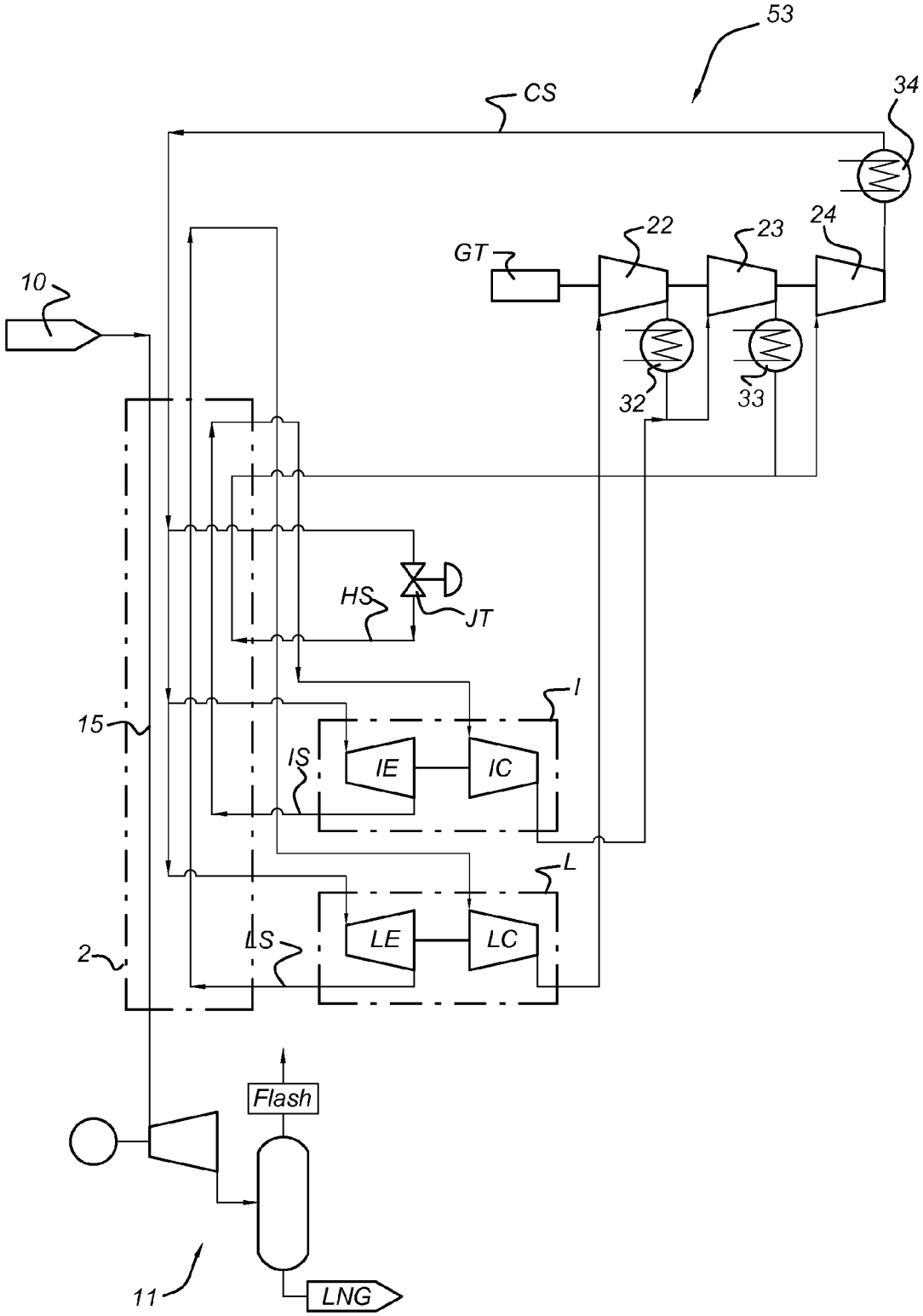
FIG. 7 shows an alternative dual expansion process according to an embodiment of the invention with a JT valve for HP expansion stage.

In FIG. 7 a yet another alternative embodiment 53 is shown in which the simpler JT valve process from FIG. 6 is combined with the alternative compressor configuration of FIG. 5 to give an alterative scheme for a triple expansion process.

The efficiency of the entire process scheme may be further improved by the addition of a pre-cooling stage using a refrigerant loop or any other refrigeration means, in order to reduce the inlet temperature of the process gas before entering the cold box", or by adding an additional refrigeration cycle to cool down the intercoolers and/or aftercoolers of the compressors.

Although particular embodiments of the invention have been described and illustrated herein, it is recognized that modifications and variations may readily occur to those skilled in the art, and consequently, it is intended that the claims be interpreted to cover such modifications and equivalents.

The invention claimed is:

1. A method of natural gas liquefaction comprising at least two nitrogen refrigerant streams, each of said at least two nitrogen streams undergoing a cycle of compression, cooling, expansion and heating, during which each of the at least two nitrogen streams is expanded to a different pressure than the others of the at least two nitrogen streams, and, the heating occurs in one or more heat exchangers; the at least two expanded nitrogen streams being in a heat exchanging relationship with a stream of the natural gas and with the at least two compressed nitrogen streams in at least one of said one or more heat exchangers, wherein at least one of said at least two expanded nitrogen streams, after having been in said heat exchanging relationship in the at least one of the one or more heat exchangers, is compressed as a side stream in a stage of a main nitrogen compressor comprising at least two compressor stages, a first compressor stage (22) and a second compressor stage (23), and wherein an outlet of the first compressor stage (22) is coupled to an inlet of the second compressor stage (23) in such a way that a compressor outlet stream from a low pressure turbo expander (L) after being pressurized in the first compressor stage (22) is added to a compressor outlet stream from a high pressure turbo expander (H) before the inlet of the second compressor stage (23) so as to combine the compressed side stream with another compressed nitrogen stream after passing said nitrogen compressor stage.

2. The method according to claim 1, wherein the main nitrogen compressor comprises at least two compressors coupled on a common drive shaft.

3. The method according to claim 1, wherein a compressed nitrogen stream from the compressor stages is divided over at least two parallel placed expanders to different pressure levels.

4. The method according to claim 3, wherein each expander is connected over a common drive shaft to a compressor for compressing a nitrogen flow.

5. The method according to claim 1, wherein the main nitrogen compressor is gas turbine driven or electric motor driven or steam turbine driven.

6. The method according to claim 1, wherein the expansion comprises a high pressure, an intermediate pressure and a low pressure expansion stage in a respective expander.

7. The method according to claim 1, wherein the main nitrogen compressor comprises three compressor stages and receives two side streams with different pressures.

8. The method according to claim 7, wherein the three compressors are coupled on a common drive shaft.

9. The method according to claim 1, wherein a third expander which is a Joule-Thompson valve is placed parallel with said low pressure and high pressure turbo expanders.

10. A natural gas liquefaction apparatus comprising a heat exchanger system of one or more heat exchangers for placing the natural gas in a heat exchanging relationship with multiple nitrogen refrigerant streams; at least two compressors for compressing a first and an at least second nitrogen refrigerant stream; a first turbo expander comprising a first expander for expanding the first nitrogen stream to a first pressure, and at least a second turbo expander comprising a second expander for expanding the at least second nitrogen stream to an at least second, lower pressure than the first pressure, wherein the apparatus further comprises a main nitrogen compressor with at least two compressor stages, each compressor stage being arranged for receiving an associated nitrogen stream, wherein an outlet of a first compressor stage (22) is coupled to an inlet of a second compressor stage (23) in such a way that a compressor outlet stream from the low pressure turbo expander (L) after being pressurized in the first compressor stage (22) is added to a compressor outlet stream from the high pressure turbo expander (H) before the inlet of the second compressor stage (23) and wherein each nitrogen stream has a different pressure other than the other of the at least two nitrogen streams, one nitrogen stream being a side stream which will be combined with the other nitrogen stream.

11. The apparatus according to claim 10, wherein the one nitrogen stream is combined with the other nitrogen stream after passing the first compressor stage and before entry of the other nitrogen stream into the second compressor stage.

12. The apparatus according to claim 10, wherein the main nitrogen compressor comprises at least two compressors coupled on a common drive shaft.

13. The apparatus according to claim 10, wherein the compressed nitrogen stream from the main nitrogen compressor is divided over at least two parallel placed expanders to different pressure levels.

14. The apparatus according to claim 12, wherein each expander is connected over a common drive shaft to a compressor arranged for compressing a nitrogen flow.

15. The apparatus according to claim 14, wherein at least one compressor receives and compresses at least a part of the nitrogen stream that passed the heat exchanger system before said part of the nitrogen stream flows to the main nitrogen compressor.

16. The apparatus according to claim 11, wherein the main nitrogen compressor unit is gas turbine driven or electric motor driven or steam turbine driven.

17. The apparatus according to claim 11, wherein the first and at least second expander comprise a high pressure, an intermediate pressure and a low pressure expansion stage in a respective expander.

18. The apparatus according to claim 11, wherein the main nitrogen compressor comprises three compressors and receives two side streams with different pressures.

19. The apparatus according to claim 18, comprising a third expander placed parallel with said first and second turbo expander, wherein said third expander is a Joule-Thompson valve.

* * * * *